US011583097B2

(12) United States Patent
Alletto, Jr.

(10) Patent No.: US 11,583,097 B2
(45) Date of Patent: Feb. 21, 2023

(54) MATTRESS ASSEMBLY

(71) Applicant: BEDGEAR, LLC, Farmingdale, NY (US)

(72) Inventor: Eugene Alletto, Jr., Glen Head, NY (US)

(73) Assignee: BEDGEAR, LLC, Farmingdale, NY (US)

( * ) Notice: Subject to any disclaimer, the term of this patent is extended or adjusted under 35 U.S.C. 154(b) by 117 days.

(21) Appl. No.: 16/177,949

(22) Filed: Nov. 1, 2018

(65) Prior Publication Data

US 2019/0125093 A1 May 2, 2019

Related U.S. Application Data

(60) Provisional application No. 62/580,067, filed on Nov. 1, 2017.

(51) Int. Cl.

| | |
|---|---|
| ***A47C 27/00*** | (2006.01) |
| ***A47C 27/06*** | (2006.01) |
| ***A47C 27/12*** | (2006.01) |
| ***A47C 27/15*** | (2006.01) |

(52) U.S. Cl.

CPC ..... *A47C 27/001* (2013.01); *A47C 27/06* (2013.01); *A47C 27/121* (2013.01); *A47C 27/122* (2013.01); *A47C 27/15* (2013.01)

(58) Field of Classification Search

CPC ..... A47C 27/001; A47C 27/045; A47C 27/06; A47C 27/063; A47C 27/121; A47C 27/122; A47C 27/15; A47C 27/061; A47C 27/062; A47C 27/064; A47C 27/065; A47C 27/066

See application file for complete search history.

(56) References Cited

U.S. PATENT DOCUMENTS

| | | | |
|---|---|---|---|
| 3,110,042 | A | 11/1963 | Slemmons |
| 3,394,414 | A | 7/1968 | Unger |
| 3,534,417 | A | 10/1970 | Truman |
| 4,190,697 | A | 2/1980 | Ahrens |
| 4,316,298 | A | 2/1982 | Russo et al. |
| 4,405,681 | A | 9/1983 | McEvoy |

(Continued)

FOREIGN PATENT DOCUMENTS

EP 2209403 A2 7/2010

OTHER PUBLICATIONS

International Search Report and Written Opinion of the International Searching Authority, European Patent Office, PCT/US2018/058693, dated Jan. 3, 2019.

*Primary Examiner* — Peter M. Cuomo
*Assistant Examiner* — George Sun
(74) *Attorney, Agent, or Firm* — Sorell, Lenna & Schmidt, LLP

(57) ABSTRACT

A mattress assembly includes a cover, a spring pack positioned within the cover, and an inner core positioned within the cover. The inner core includes opposite first and second portions. The first portion has a firmness that is different than a firmness of the second portion. The inner core is configured to be moved between a first configuration in which the first portion directly engages the spring pack and a second configuration in which the second portion directly engages the spring pack to alter a firmness of a sleep surface of the mattress. Methods of use are disclosed.

21 Claims, 7 Drawing Sheets

(56) References Cited

U.S. PATENT DOCUMENTS 4,476,594 A 10/1984 McLeod
RE32,734 E 8/1988 McLeod
5,604,021 A 2/1997 Wagner
5,819,349 A 10/1998 Schwartz
6,988,287 B1 1/2006 Swartzburg
7,240,386 B1 7/2007 McKay et al.
7,661,166 B1 2/2010 Marling et al.
7,861,342 B1 * 1/2011 Huang ..... A47C 27/056 5/716
8,065,767 B2 11/2011 Gabbai et al.
8,302,229 B1 * 11/2012 Bullard ..... A47C 27/066 5/737
8,418,297 B2 4/2013 Collins et al.
9,167,909 B2 10/2015 Cappadona et al.
9,814,642 B2 * 11/2017 Purdy ..... A61G 7/05776
9,820,579 B2 * 11/2017 Silver ..... A47C 27/15
2002/0029425 A1 * 3/2002 Henley ..... A47C 27/20 5/722
2004/0237206 A1 12/2004 Webster et al.
2008/0229507 A1 9/2008 Healy
2009/0019825 A1 * 1/2009 Skirius ..... B01D 46/521 55/524
2010/0077552 A1 4/2010 Malikhin et al.
2010/0148562 A1 * 6/2010 McClung ..... A47C 27/148 29/428
2010/0170042 A1 7/2010 Rose
2010/0229302 A1 * 9/2010 De Bock ..... A47C 31/006 5/248
2011/0197363 A1 * 8/2011 Kokenes ..... B32B 27/08 428/317.1
2011/0258782 A1 * 10/2011 Call ..... A61G 5/1043 137/15.01
2012/0159714 A1 6/2012 Cortright
2012/0276797 A1 * 11/2012 Kub ..... A47C 31/007 442/381
2013/0174344 A1 * 7/2013 Klancnik ..... A47C 27/15 428/221
2014/0059775 A1 * 3/2014 Khanzadian ..... B29C 33/40 264/261
2014/0090178 A1 4/2014 Morgan et al.
2016/0066700 A1 * 3/2016 Lin ..... A47C 27/121 5/652.1
2016/0345745 A1 * 12/2016 Zoltan ..... D04H 1/559
2017/0112293 A1 4/2017 Battaglia
2017/0224126 A1 8/2017 O'Connell, Jr.
2018/0325276 A1 * 11/2018 Wyler ..... A47C 27/062
2019/0053632 A1 * 2/2019 Chirackal ..... B32B 5/18
2019/0090652 A1 * 3/2019 Leng ..... A47C 7/14

* cited by examiner

MATTRESS ASSEMBLY

TECHNICAL FIELD

The present disclosure generally relates to mattresses, and more particularly to mattress assemblies that include a dual-side mattress having two different comfort choices.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that suit both their personal sleep preference and body type in order to achieve comfortable, restful sleep.

Infants and toddlers often require firmer mattresses than older children. In order to prevent having to purchase a new mattress when children become older, some mattresses include a first side having a firmness that is suited for toddlers and a second side having a firmness that is suited for older children. In that young children are likely to wet the bed, such mattresses may include a waterproof cover to prevent urine from getting into the mattress. However, such waterproof covers prevent body heat from ventilating through the mattress and are hence uncomfortable to sleep on. Furthermore, conventional mattresses typically include a cover that is sewn onto an inner core of the mattress, thus requiring that the cover be flipped when the mattress is flipped. This disclosure describes an improvement over these prior art technologies.

SUMMARY

In one embodiment, in accordance with the principles of the present disclosure, a mattress assembly is provided that includes a cover, a spring pack positioned within the cover, and an inner core positioned within the cover. The inner core includes opposite first and second portions. The first portion has a firmness that is different than a firmness of the second portion. The inner core is configured to be moved between a first configuration in which the first portion directly engages the spring pack and a second configuration in which the second portion directly engages the spring pack to alter a firmness of a sleep surface of the mattress.

In one embodiment, in accordance with the principles of the present disclosure, a mattress assembly is provided that includes a cover, a spring pack positioned within the cover, and an inner core positioned within the cover. The cover comprises a porous, non-waterproof material and a zipper. The spring pack comprises opposite first and second surfaces and a plurality of springs positioned between the first and second surfaces. The first surface defines a waterproof barrier. The inner core comprises a matrix of polyurethane fibers. The matrix comprises opposite first and second portions. The fibers that make up the first portion are more densely packed than the fibers that make up the second portion such that the first portion has a firmness that is greater than a firmness of the second portion. The inner core is configured to be moved between a first configuration in which the first portion directly engages the waterproof barrier and a second configuration in which the second portion directly engages the waterproof barrier to alter a firmness of a sleep surface of the mattress.

In one embodiment, in accordance with the principles of the present disclosure, a mattress assembly is provided that includes a cover, a spring pack positioned within the cover, and an inner core positioned within the cover. The cover comprises a porous, non-waterproof material and a zipper. The spring pack comprises opposite first and second surfaces and a plurality of springs positioned between the first and second surfaces. The first surface defines a waterproof barrier. The inner core comprises a mat of electrospun polyurethane fibers. The mat comprises opposite first and second portions. The fibers that make up the first portion are more densely packed than the fibers that make up the second portion such that the first portion has a firmness that is greater than a firmness of the second portion. The inner core is configured to be moved between a first configuration in which the first portion directly engages the waterproof barrier and a second configuration in which the second portion directly engages the waterproof barrier to alter a firmness of a sleep surface of the mattress.

BRIEF DESCRIPTION OF THE DRAWINGS

The present disclosure will become more readily apparent from the specific description accompanied by the following drawings, in which.

DETAILED DESCRIPTION

Figure 1:
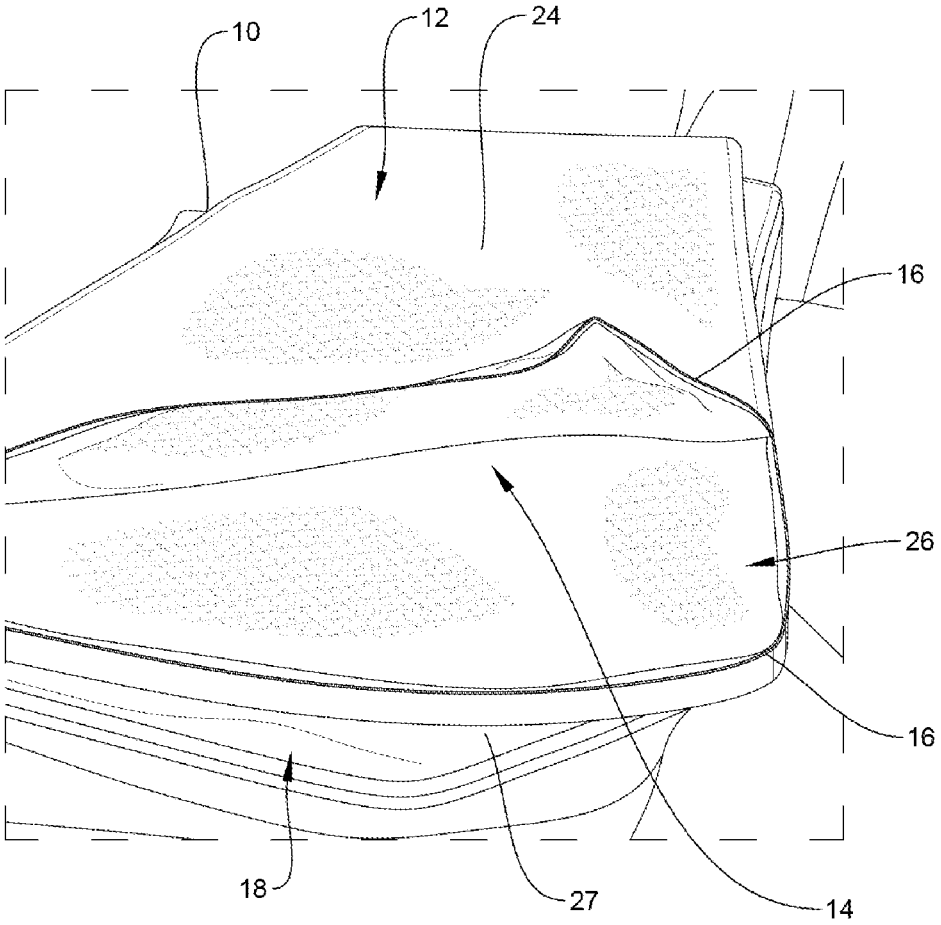
FIG. 1 is a perspective view of one embodiment of a mattress assembly in accordance with the present principles of the present disclosure.
Figure 2:
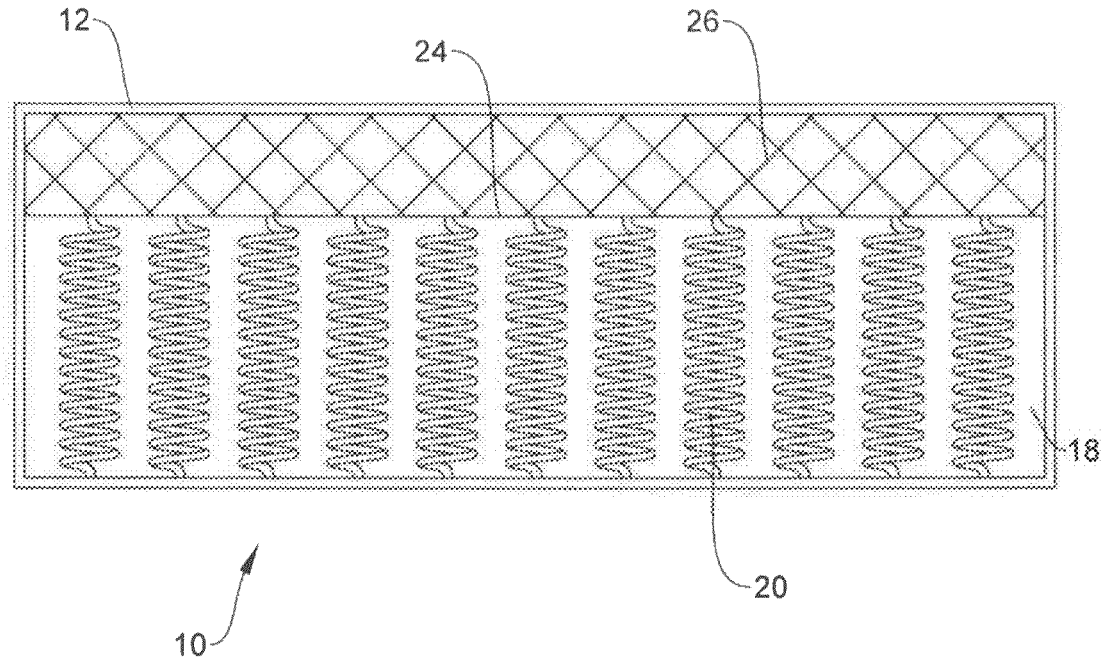
FIG. 2 is a cross sectional view of the mattress assembly shown in FIG. 1.
Figure 3:
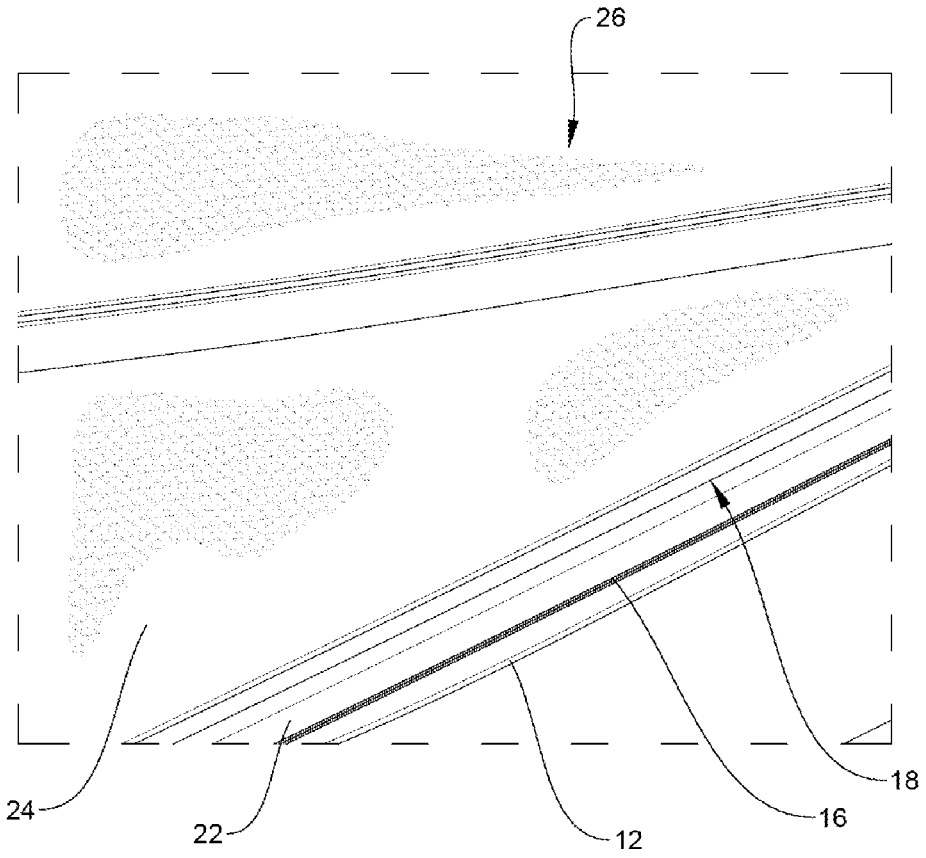
FIG. 3 is a perspective view of components of the mattress assembly shown in FIG. 1.
Figure 4:
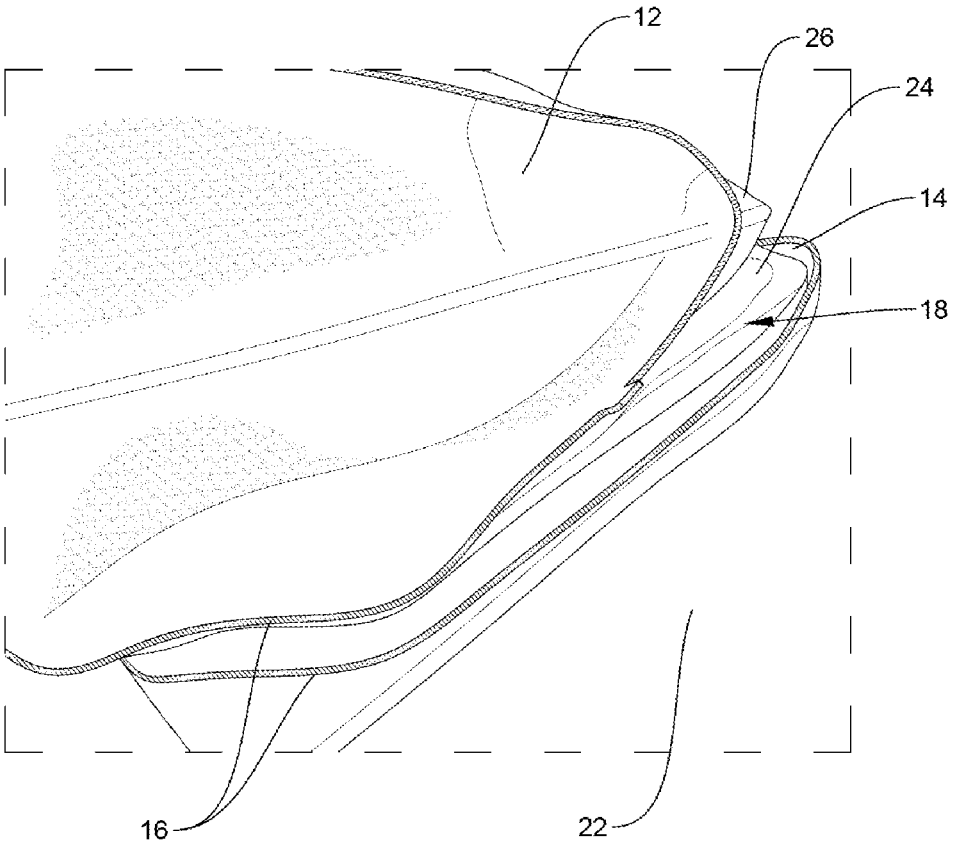
FIG. 4 is a perspective view of components of the mattress assembly shown in FIG. 1.
Figure 5:
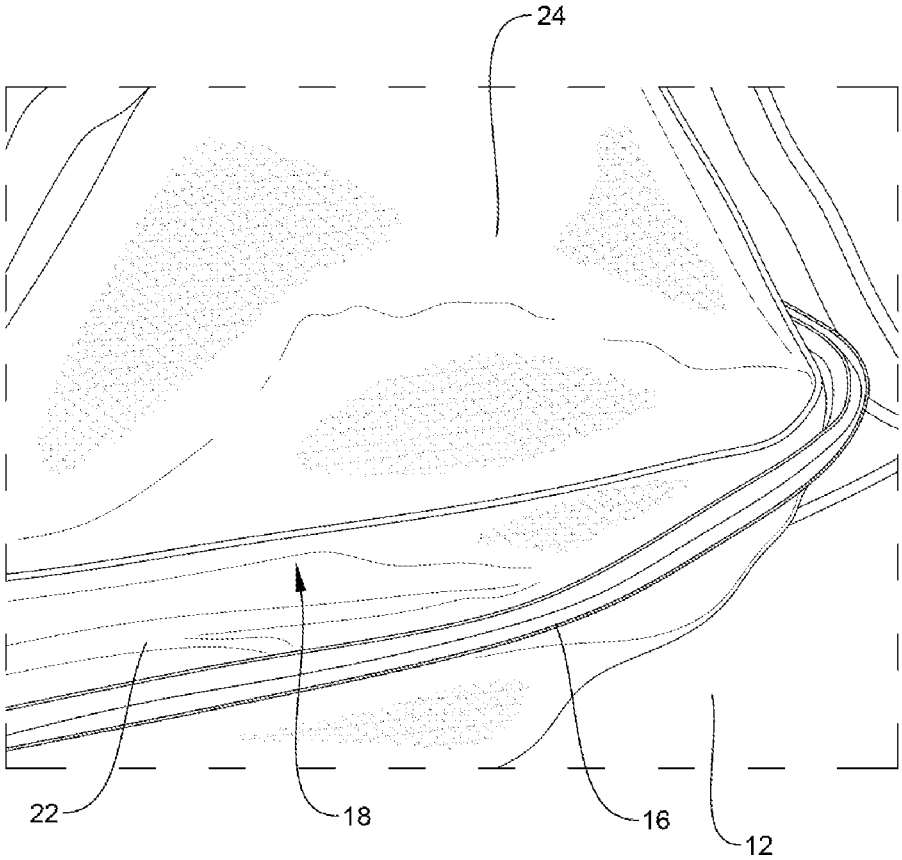
FIG. 5 is a perspective view of components of the mattress assembly shown in FIG. 1.
Figure 6:
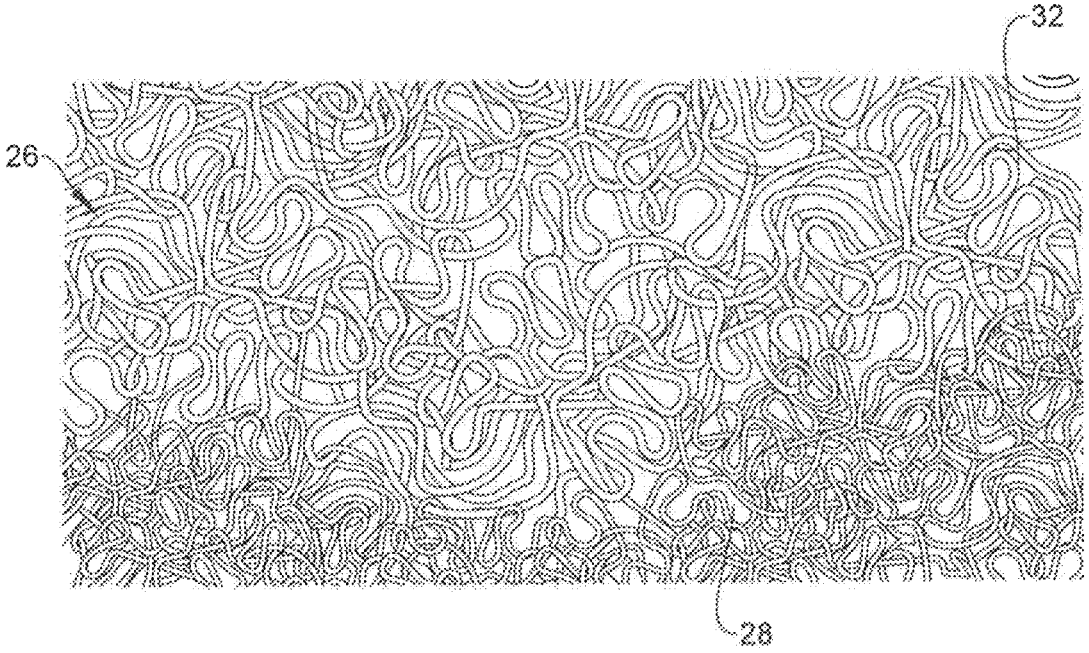
FIG. 6 is a perspective view of a component of the mattress assembly shown in FIG. 1.
Figure 7:
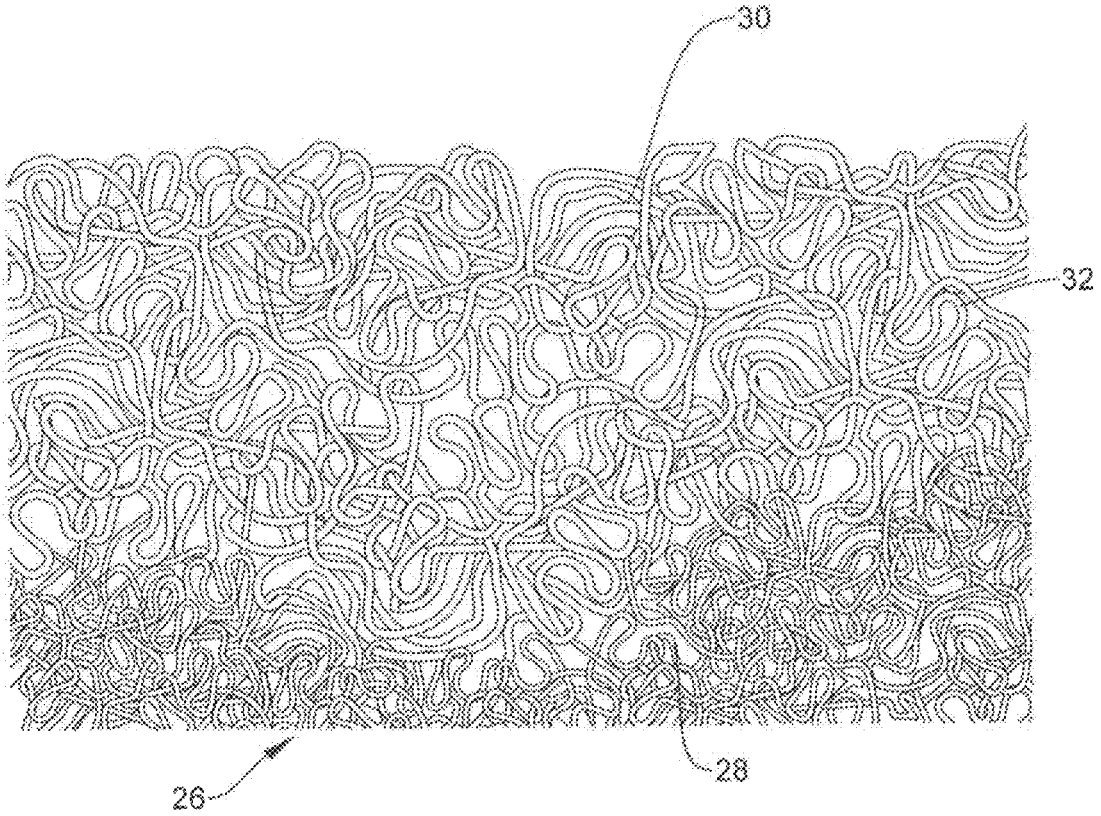
FIG. 7 is a perspective view of a component of the mattress assembly shown in FIG. 1.

The exemplary embodiments are discussed in terms of mattresses, such as, for example, mattress assemblies that include a dual-side inner core having two different comfort choices. The present disclosure may be understood more readily by reference to the following detailed description of the disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" or "top" and "bottom" are relative and used only in the context to the other, and are not necessarily "superior" and "inferior".

The following discussion includes a description of a mattress assembly 10. Alternate embodiments are also disclosed. Reference will now be made in detail to the exemplary embodiments of the present disclosure.

The components of mattress assembly 10 can be fabricated from materials including metals, synthetic polymers, ceramics and/or their composites, depending on the particular application and/or preference. For example, the components of mattress assembly 10, individually or collectively, can be fabricated from materials such as stainless steel alloys, aluminum, commercially pure titanium, titanium alloys, Grade 5 titanium, super-elastic titanium alloys, cobalt-chrome alloys, stainless steel alloys, superelastic metallic alloys (e.g., Nitinol, super elasto-plastic metals, such as GUM METAL® manufactured by Toyota Material Incorporated of Japan), ceramics, thermoplastics such as polyaryletherketone (PAEK) including polyetheretherketone (PEEK), polyetherketoneketone (PEKK) and polyetherketone (PEK), carbon-PEEK composites, PEEK-$BaSO_4$ polymeric rubbers, polyethylene terephthalate (PET), fabric, silicone, polyurethane, silicone-polyurethane copolymers, polymeric rubbers, polyolefin rubbers, hydrogels, semi-rigid and rigid materials, elastomers, rubbers, thermoplastic elastomers, thermoset elastomers, elastomeric composites, rigid polymers including polyphenylene, polyamide, polyimide, polyetherimide, polyethylene, and epoxy. Mattress assembly 10 may be made from materials such as, for example, one or more of cotton, kapok, flax, linen, jute, ramie, hemp, kenaf, bamboo, coir, sisal, silk, wool (sheep), alpaca, llama, goat (mohair, cashmere), rabbit (angora), camel, horse, yak, vicuna, qiviut, guanaco, rayon, azlon, lyocell, acetate, triacetate, rubber, polyester, olefin, nylon, acrylic, modacrylic, aramid, spandex. Mattress assembly 10 is made such that mattress assembly 10 is compliant with all U.S. Federal Mattress Regulations, such as, for example, 16 C.F.R. §§ 1632 and 1633. Various components of mattress assembly 10 may have material composites, including the above materials, to achieve various desired characteristics such as strength, rigidity, elasticity, compliance, mechanical performance, and durability. The components of mattress assembly 10, individually or collectively, may also be fabricated from a heterogeneous material such as a combination of two or more of the above-described materials. The components of mattress assembly 10 may be monolithically formed, integrally connected or include fastening elements and/or instruments, as described herein.

Mattress assembly 10 includes a cover 12 that defines a pocket 14. In some embodiments, cover 12 includes only one pocket, such as, for example, pocket 14. In some embodiments, cover 12 includes a plurality of discrete pockets. In some embodiments, cover 12 includes a fastener, such as, for example, a zipper 16 to provide access to pocket 14. In some embodiments, cover 12 comprises a porous material, such as, for example, a porous fabric that allows air to move in and out of pocket through cover 12. In some embodiments, cover 12 comprises a breathable material, such as, for example, a breathable fabric that allows air to move in and out of pocket through cover 12. In some embodiments, cover 12 is made entirely of a porous material and/or a breathable material. That is, no portion of cover 12 is waterproof. In some embodiments, cover 12 is washable. That is, cover 12 is configured to be washed in a standard washing machine.

One or a plurality of spring packs 18 is/are positioned within pocket 14. Spring pack 18 comprises a plurality of springs 20 positioned within a pouch 22. Springs 20 are enclosed within pouch 22. Spring pack 18 comprises one or a plurality of rows of springs 20 and one or a plurality of columns of springs 20. In some embodiments, spring pack 18 includes a plurality of rows of springs 20 and a plurality of columns of springs 20. In some embodiments, spring pack 18 includes a plurality of strings of springs, as described in U.S. Patent Application No. 62/347,199 to the inventor of the current application, which is incorporated by reference herein, in its entirety. In some embodiments, springs 20 are each positioned within a pocket, such as, for example, a fabric pocket. The pockets may be coupled to one another to form a string of pockets that each include one of springs 20 therein. In some embodiments, the string of pockets includes one or more slits between adjacent pockets to allow springs 20 to move independently of one another. In some embodiments, the sting of pockets includes one or more slits that extend through a top surface of the string of pockets between adjacent pockets and/or one or more slits that extend through a bottom surface of the string of pockets between adjacent pockets. In some embodiments, spring pack 18 is permanently fixed to cover 12. In some embodiments, spring pack 18 is removably disposed within pocket 14.

Pouch 22 includes a bottom surface that directly engages cover 12 and an opposite top surface 24. Springs 20 are positioned between the bottom surface of pouch 22 and surface 24. In some embodiments, surface 24 comprises a waterproof material such that surface 24 defines a waterproof barrier of pouch 22 that prevents liquids from passing through surface 24 to prevent liquids or moisture from entering pouch 22 through surface 24. In some embodiments, surface 24 is entirely waterproof. That is, the entire area of surface 24 that is defined by the perimeter of surface 24 is waterproof. In some embodiments, surface 24 is non-porous. In some embodiments, surface 24 comprises a waterproof fabric. In some embodiments, surface 24 comprises a waterproof polymer. In some embodiments, surface 24 comprises a thermoplastic polyurethane. In some embodiments, surface 24 comprises a thermoplastic polyurethane breathable waterproof fabric. In some embodiments, surface 24 comprises a porous fabric that is coated with a waterproof material.

In some embodiments, mattress assembly 10 does not include any springs, such as, for example, spring pack 18. In some embodiments, mattress assembly 10 includes a material, such as, for example, a foam block in place of spring pack 18.

An inner core 26 is removably positioned within pocket 14 such that core 26 directly engages surface 24 of spring pack 18. Core 26 includes opposite first and second portions 28, 30 and a middle portion 32 between portions 28, 30. Portion 28 has a firmness that is different than a firmness of portion 30 to provide two different comfort choices. For example, core 26 can include a firmer side for toddlers and a softer side for tweens. In some embodiments, portion 32 has a firmness that is less than a firmness of portion 28 and a firmness of portion 30. Core 26 can be flipped as the child grows to prevent the need to buy another mattress as the child ages. For example, the same mattress can be used from when the child is 2 or 3 years old until the child is 12 or 13 years old. Core 26 is configured to be moved between a first configuration in which portion 28 directly engages surface 24 of spring pack 18 and a second configuration in which portion 30 directly engages surface 24 to alter a firmness of a sleep surface 34 of mattress assembly 10.

In some embodiments, core 26 comprises a matrix of fibers. The fibers that make up portion 28 are more densely packed than the fibers that make up portion 30 such that portion 28 is firmer than portion 30. In some embodiments, the fibers are made from a polymer, such as, for example, polyurethane. In some embodiments, core 26 consists of the fibers. That is, core 26 does not include any material or components other than the fibers. In some embodiments, core 26 comprises a mat of electrospun fibers. A first side of core 26 that defines portion 28 and a second side of core 26 that defines portion 30 are heat pressed to provide portions 28, 30 with selected firmnesses. In some embodiments, portion 28 is heat pressed for a longer duration of time and/or at a higher temperature than portion 30 to make portion 28 firmer than portion 30. In some embodiments, core 26 is washable. That is, core 26 is configured to be washed using water to remove any urine or other material on the fibers that make up core 26. In some embodiments, core 26 is free of any foam.

In operation and use, core 26 may be positioned within pocket 14 such that portion 30 directly engages surface 24 of spring pack 18 and portion 28 is positioned adjacent to sleep surface 34 of mattress assembly 10 to provide sleep surface 34 with a firmness sufficient to accommodate infants or toddlers. If the infant or toddler should wet the bed, the urine will move through cover 12 and core 26 and onto surface 24 of spring pack 18. To clean mattress assembly 10, zipper 16 of cover 12 can be moved from a closed configuration to an open configuration. Spring pack 18 and core 26 may be removed from pocket 14 when zipper 16 is in the open configuration. Cover 12 may be cleaned in a standard washing machine, for example. Spring pack 18 may be cleaned by wiping any urine off of surface 24. A cleaning material, such as, for example, bleach or vinegar may be applied to surface 24 before surface 24 is wiped clean. Core 26 may be cleaned by rinsing core 26 with water, for example. After cover 12, spring pack 18 and core 26 are cleaned, spring pack 18 may be repositioned within pocket 14. Core 26 is then inserted into pocket 14 such that portion 30 directly engages surface 24 of spring pack 18 and portion 28 is positioned adjacent to sleep surface 34 of mattress assembly 10. Zipper 16 is then moved from the open configuration to the closed configuration.

As the infant or toddler ages, he or she may desire that sleep surface 34 be less firm. To alter the firmness of sleep surface 34, zipper 16 of cover 12 can be moved from the closed configuration to the open configuration. Core 26 is removed from pocket 14 when zipper 16 is in the open configuration. Core 26 is flipped and is repositioned within pocket such that portion 28 directly engages surface 24 of spring pack 18 and portion 30 is positioned adjacent to sleep surface 34 of mattress assembly 10 to provide sleep surface 34 with a firmness sufficient to accommodate older children. In some embodiments, spring pack 18 remains within pocket 14 while core 26 is being flipped. That is, cover 12 and spring pack 18 are not flipped to alter the firmness of sleep surface 34. Rather, only core 26 is flipped, while cover 12 and spring pack 18 remain stationary. Should mattress assembly 10 become soiled, spring pack 18 and core 26 may be removed from pocket 14 and cover 12, spring pack 18 and/or core 26 may be cleaned, as discussed herein. After cover 12, spring pack 18 and/or core 26 is/are cleaned, spring pack 18 and core 26 may be repositioned within pocket 14, as discussed herein.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A mattress comprising:

a cover;

a spring pack comprising a pouch having opposite first and second surfaces, the spring pack comprising a plurality of springs disposed within the pouch, the spring pack being positioned within the cover such that the second surface directly engages the cover, the first surface defining a waterproof barrier; and an inner core positioned within the cover, the inner core comprising opposite first and second ends and opposite first and second sides each extending from the first end to the second end, the inner core comprising opposite first and second portions and a third portion between the first and second portions, the first, second and third portions each extending continuously from the first end to the second end and from the first side to the second side, the first portion having a firmness that is different than a firmness of the second portion, the third portion having a firmness that is less than the firmness of the first portion and the firmness of the second portion, wherein the inner core is configured to be moved between a first configuration in which the first portion directly engages the first surface and a second configuration in which the second portion directly engages the first surface to alter a firmness of a sleep surface of the mattress.

2. A mattress as recited in claim 1, wherein the inner core comprises a matrix of fibers, the fibers that make up the first portion being more densely packed than the fibers that make up the second portion, the fibers that make up the third portion being less densely packed than the fibers that make up the second portion.

3. A mattress as recited in claim 1, wherein the inner core comprises a matrix of polymer fibers.

4. A mattress as recited in claim 1, wherein the inner core comprises a matrix of polyurethane fibers, the fibers that make up the first portion being more densely packed than the fibers that make up the second portion, the fibers that make up the third portion being less densely packed than the fibers that make up the second portion.

5. A mattress as recited in claim 1, wherein the inner core comprises a mat of electrospun fibers.

6. A mattress as recited in claim 1, wherein the inner core comprises a mat of electrospun polymer fibers.

7. A mattress as recited in claim 1, wherein the first surface comprises a porous fabric that is coated with a waterproof material.

8. A mattress as recited in claim 1, wherein the first surface is non-porous.

9. A mattress as recited in claim 1, wherein the first surface comprises a thermoplastic polyurethane.

10. A mattress as recited in claim 1, wherein the first surface comprises a thermoplastic polyurethane breathable waterproof fabric.

11. A mattress as recited in claim 1, wherein the spring pack is permanently fixed to the cover.

12. A mattress as recited in claim 1, wherein the spring pack is removably disposed within the cover.

13. A mattress as recited in claim 1, wherein the cover comprises a porous material.

14. A mattress as recited in claim 1, wherein the cover is not waterproof.

15. A mattress as recited in claim 1, wherein the cover includes a fastener to allow the inner core to be removed from the cover.

16. A mattress comprising:

a cover made entirely from a porous material;

a fastener coupled to the cover, an outside surface of the cover defining a sleep surface;

a spring pack positioned within the cover such that the spring pack directly engages the cover, the spring pack comprising a pouch having opposite first and second surfaces and a plurality of springs positioned within the pouch, the first surface defining a waterproof barrier; and an inner core positioned within the cover, the inner core comprising a matrix of polymer fibers, the matrix comprising opposite first and second ends and opposite first and second sides each extending from the first end to the second end, the matrix comprising opposite first and second portions and a third portion between the first and second portions, the first, second and third portions each extending continuously from the first end to the second end and from the first side to the second side, the fibers that make up the first portion being more densely packed than the fibers that make up the second portion such that the first portion has a firmness that is greater than a firmness of the second portion, the fibers that make up the third portion being less dense than the fibers that make up the second portion such that the third portion has a firmness that is less than the firmness of the second portion, wherein the inner core is configured to be moved between a first configuration in which the first portion directly engages the waterproof barrier and a second configuration in which the second portion directly engages the waterproof barrier to alter a firmness of the sleep surface of the mattress.

17. A mattress comprising:

a monolithic cover made entirely from a porous material;

a fastener coupled to the cover, an outside surface of the cover defining a sleep surface;

a spring pack positioned within the cover such that the spring pack directly engages the cover, the spring pack comprising a pouch having opposite first and second surfaces and a plurality of springs enclosed within the pouch, the first surface comprising a non-porous fabric that is coated with a waterproof material; and an inner core positioned within the cover, the inner core comprising a matrix of polymer fibers, the matrix comprising opposite first and second ends and opposite first and second sides each extending from the first end to the second end, the matrix comprising opposite first and second portions and a third portion between the first and second portions, the first, second and third portions each extending continuously from the first end to the second end and from the first side to the second side, the fibers that make up the first portion being more densely packed than the fibers that make up the second portion such that the first portion has a firmness that is greater than a firmness of the second portion, the fibers that make up the third portion being less dense than the fibers that make up the second portion such that the third portion has a firmness that is less than the firmness of the second portion, wherein the inner core is configured to be moved between a first configuration in which the first portion directly engages the cover and the second section directly engages the first surface and a second configuration in which the second portion directly engages the cover and the first section directly engages the first surface to alter a firmness of the sleep surface of the mattress.

18. A mattress as recited in claim 1, wherein the cover defines a pocket, the spring pack being positioned within the pocket such that a bottom surface of the spring pack directly engages a planar inner surface of the cover and an opposite top surface of the spring pack directly engages the inner core.

19. A mattress as recited in claim 1, wherein the cover defines a pocket and includes a fastener to provide access to the pocket, the spring pack being positioned within the pocket such that the second surface of the spring pack directly engages a planar inner surface of the cover and the first surface of the spring pack directly engages the inner core.

20. A mattress as recited in claim 1, wherein the cover comprises opposite top and bottom walls, inner surfaces of the walls defining a pocket, the inner surface of the bottom wall being planar, the spring pack being positioned within the pocket such that the second surface of the spring pack directly engages the planar inner surface of the bottom wall and the first surface of the spring pack directly engages the inner core.

21. A mattress consisting of:

a cover;

a single spring pack positioned within the cover such that the spring pack directly engages the cover, the spring pack comprising a pouch having opposite first and second surfaces and a plurality of springs positioned within the pouch, the first surface defining a waterproof barrier; and an inner core positioned within the cover, the inner core comprising opposite first and second ends and opposite first and second sides each extending from the first end to the second end, the inner core comprising opposite first and second portions and a third portion between the first and second portions, the first, second and third portions each extending continuously from the first end to the second end and from the first side to the second side, the first portion having a firmness that is different than a firmness of the second portion, the third portion having a firmness that is less than the firmness of the first portion and the firmness of the second portion, wherein the inner core is configured to be moved between a first configuration in which the first portion directly engages the first surface and a second configuration in which the second portion directly engages the first surface to alter a firmness of a sleep surface of the mattress.

* * * * *